US005535928A

United States Patent [19]

Herring

[11] Patent Number: 5,535,928

[45] Date of Patent: Jul. 16, 1996

[54] BELT-SUPPORTABLE CARRIER FOR PORTABLE ARTICLES

[75] Inventor: Steven J. Herring, Virginia Beach, Va.

[73] Assignee: VEL-TYE, L.L.C., Virginia Beach, Va.

[21] Appl. No.: 403,192

[22] Filed: Mar. 13, 1995

[51] Int. Cl.[6] ..... A45F 5/00

[52] U.S. Cl. ..... 224/250; 224/901

[58] Field of Search ..... 224/253, 250, 224/901, 226

[56] References Cited

U.S. PATENT DOCUMENTS

| | | | |
|---|---|---|---|
| 4,420,104 | 12/1983 | Dilenno | 224/250 |
| 4,759,963 | 7/1988 | Uso, Jr. et al. . | |
| 4,862,563 | 9/1989 | Flynn . | |
| 4,937,920 | 7/1990 | Tsai . | |
| 5,008,987 | 4/1991 | Armour, II . | |
| 5,086,543 | 2/1992 | Mitchell . | |
| 5,104,076 | 4/1992 | Goodall, Jr. . | |
| 5,136,759 | 8/1992 | Armour, II . | |
| 5,163,591 | 11/1992 | Leiserson et al. | 224/250 X |
| 5,174,483 | 12/1992 | Moore, IV et al. | 224/250 |
| 5,186,373 | 2/1993 | Taylor . | |
| 5,289,619 | 3/1994 | Pileggi . | |
| 5,407,110 | 4/1995 | Marsh, Jr. | 224/250 X |

*Primary Examiner*—Renee S. Luebke

*Attorney, Agent, or Firm*—Pollock, Vande Sande & Priddy

[57] ABSTRACT

An article carrier having an elongated central strap with a fixed loop at one end, a cross-tab at the other end, and a cross-strap fixed to an intermediate portion of the central strap between the respective ends thereof. Left and right transverse segments of the cross-strap have distal end portions arranged to be placed in opposing overlapped relation within the fixed loop, and the cross-tab is arranged to be placed in opposing relation to an outside surface section of the cross-strap. Opposing surfaces of the overlapped segments and opposing surfaces of the cross-tab and cross-strap have cooperating panels of hook and loop materials for releasably connecting the article carrier in a configured orientation and for providing size adjustability thereof. A belt loop for supporting the carrier is provided by a folded portion of the central strap between the cross-strap and the cross-tab when the cross-strap and cross-tab are releasably connected together. Multiple cross-straps and a releasably connected hold-down strap are optionally provided.

16 Claims, 2 Drawing Sheets

FIG. 2
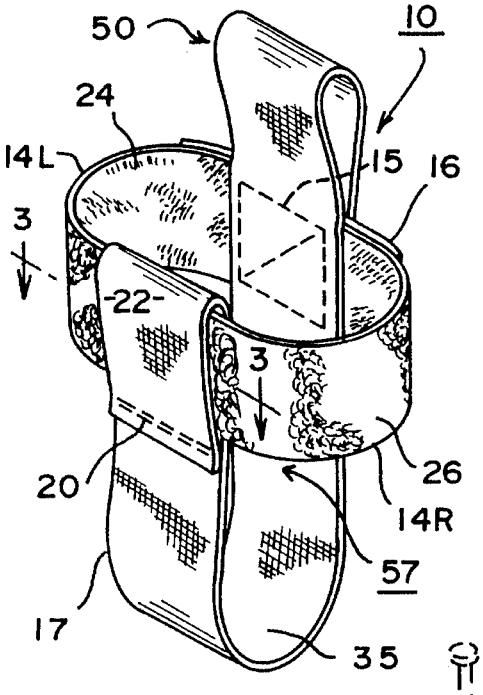
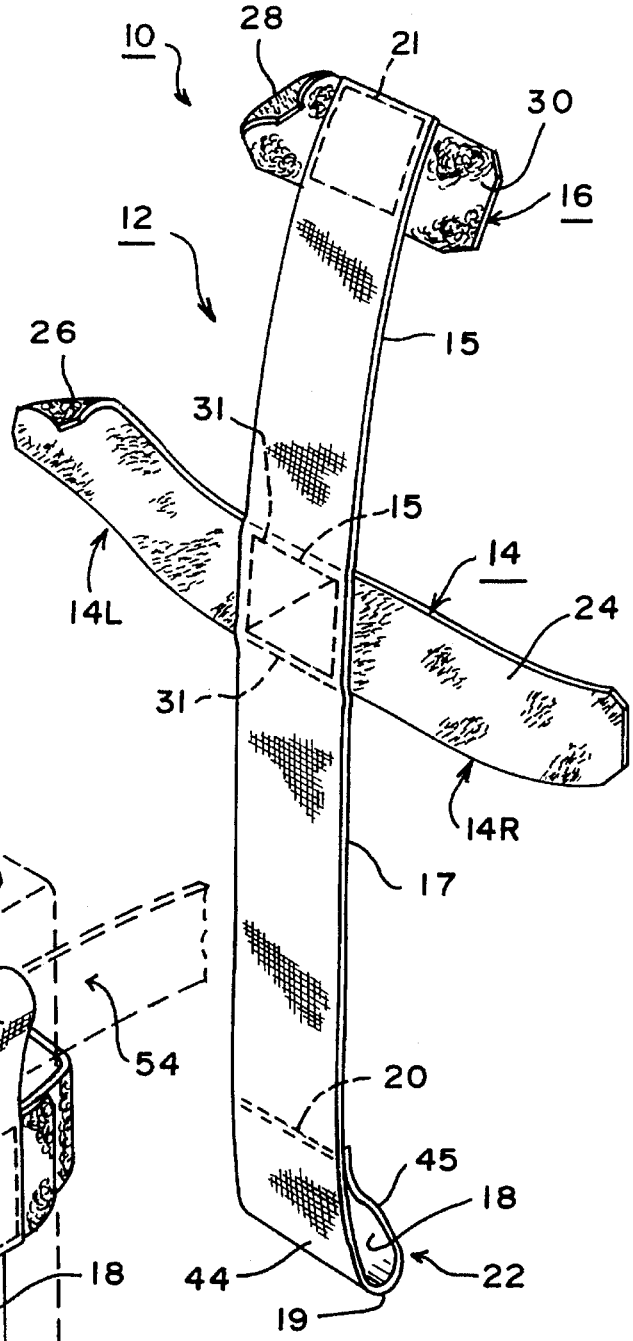
FIG. 1
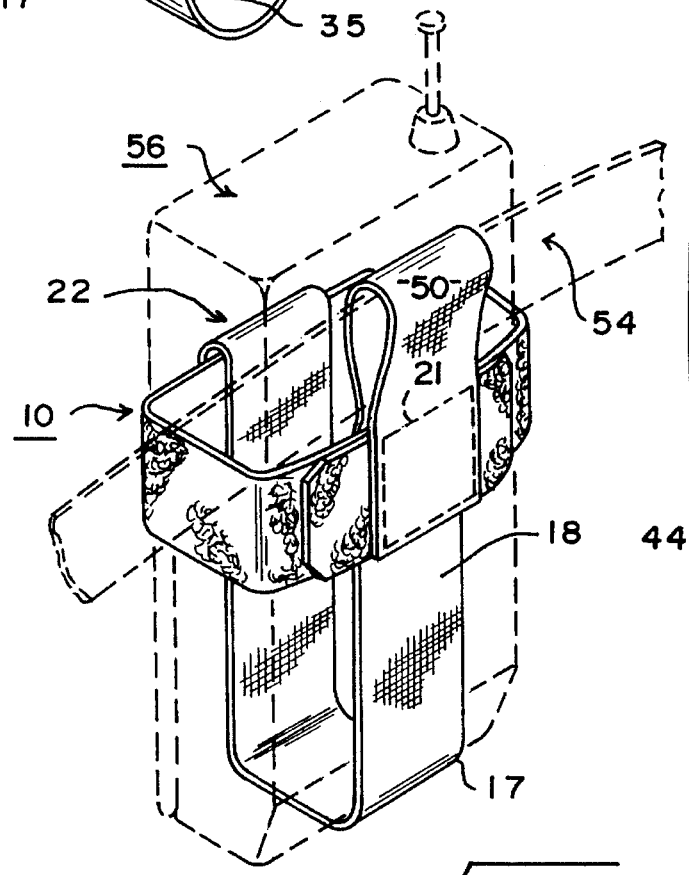
FIG. 4

71
75
70
76
16
21
50
70
14L
14
14R
14R
-22-
73
72
15
26
14L
64
62
61
60
74
60L
-58-
60L
60R
63
68
58
66
67
69
20
45
44
22
34
40
22
44
36
24
36
24
14R
26
38
14L
26
38
45
32

BELT-SUPPORTABLE CARRIER FOR PORTABLE ARTICLES

FIELD OF THE INVENTION

The present invention relates to a carrier for portable articles, and more particularly to a belt-supportable carrier which is adjustable to hold devices of various sizes, especially communication devices such as pagers, flip-phones, cellular phones, telephone handsets and hand-held two-way radios.

BACKGROUND OF THE INVENTION

In the current mobile communications market place, there are numerous portable paging and telephone devices which come in a variety of non-uniform sizes. These devices include relatively small pagers and flip-phones, as well as the significantly larger and older types of cellular phones and hand-held two-way radios. In addition, telephone company installers and maintenance personnel often carry relatively large telephone handsets for testing hardware functions in various locations, some of which are difficult to reach and periodically require that both hands be free for other uses. Such communication devices may be carried most conveniently on the belt of the user.

Fastening devices and article holders for mounting or carrying a specific portable article are known, but the usefulness of these devices is limited to the specific article for which they were designed. It is also known to use special belts with pockets or loops specifically designed to carry a variety of different articles at the same time. However, belts of this nature involve wearing them as a second belt and are often cumbersome and unattractive. Furthermore, both specifically designed article holders and specifically designed belts are limited to holding an article of the specific size for which each pocket, loop or retaining enclosure was designed.

SUMMARY OF THE INVENTION

The present invention provides a belt-supported article carrier that is simple and economical to manufacture and is adaptable to carry a wide variety of communication devices having different sizes and shapes. A preferred embodiment of the article carrier is made entirely from flexible, strap-like materials and has an elongated central strap and a traverse cross-strap that extends across and substantially perpendicular to the central strap. Intermediate portions of these straps are fixed to each other to form a substantially cross-shaped body which has a substantially planar orientation when in an unfolded condition. Outwardly extending portions of the cross-strap form right and left traverse segments.

At one end of the central strap is a fixed loop, and in a folded configuration of the body, the fixed loop receives overlapped and detachably connected distal end portions of the right and left transverse segments to form an article retaining enclosure that may be adjusted to the size of the article to be carried therein. At the end opposite the fixed loop, the central strap has a transversely extending cross-tab adapted to releasably engage an outer surface of the central strap or superimposed cross-strap when the portion of the central strap between the cross-strap and the cross-tab is folded back on itself. The folded back portion thereby forms a releasable loop for receiving the belt of a user to support thereon both the carrier and an article placed in its enclosure.

The preferred means for detachably connecting to each other the overlapped distal end portions of the cross-strap, and for detachably connecting the outer surface of the cross-strap to an inner surface of the cross-tab, is a panel of loop material on one opposing surface and a panel of hook material on the other opposing surface. These opposing surfaces become detachably connected to each other when pressed together because of the releasable hook and loop engagement provided by the corresponding materials, the preferred hook and loop materials currently being available under the trademark "VELCRO".

In another preferred embodiment for larger articles, the article carrier further comprises a second cross-strap, the distal end portions of which are similarly overlapped and releasably engaged within a second fixed loop. Both the first and the second fixed loops are preferably configured out of a correspondingly folded back end portion of the central strap.

An optional feature of the invention usable in either or both of the preferred embodiments is a hold-down strap having one end fixedly secured to either one of the transverse cross-strap segments. The other end of the hold-down strap may be detachably connected to the other of the transverse segments in a position causing an intermediate portion of this strap to pass over and engage the top of an article placed in the carrier enclosure. Another optional feature is the provision of loop material of at least some type within each fixed loop such that the fixed loop may be releasably engaged by a corresponding hook material when the overlapped portions of the corresponding cross-strap are received within the fixed loop. Since the width, length and thickness of the communication devices to be carried may vary greatly, the article carrier of the present invention provides adjustability to accommodate variations in all three of these article dimensions.

BRIEF DESCRIPTION OF THE DRAWINGS

The features and advantages of the present invention may be further understood by reference to the detailed description below in conjunction with the accompanying drawings, in which:

FIG. 1 is a front perspective view of the article carrier of the invention showing it unfolded into a generally planar orientation;

FIG. 2 is a front perspective view of the article carrier of FIG. 1 in its configured orientation;

FIG. 4 is a rear perspective view of the article carrier of FIG. 2 illustrating its support by a belt and the carrying of an article therein;

DETAILED DESCRIPTION OF THE PREFERRED EMBODIMENTS

Figures 3, 5, 6:
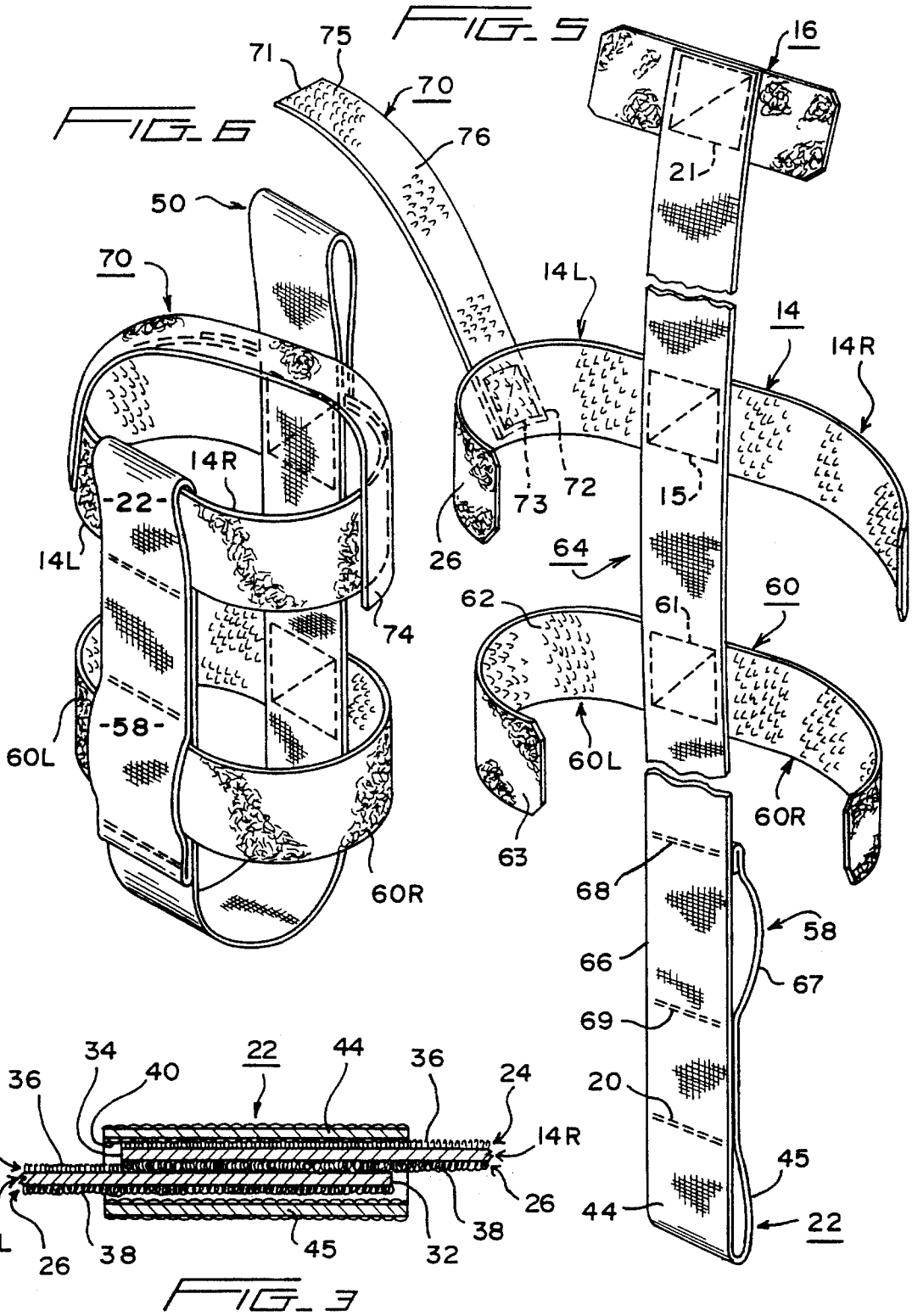
FIG. 3 is a fragmentary cross-sectional view taken along line 3—3 of FIG. 2 to illustrate structural details of the sectioned components.
FIG. 5 is a front perspective view of a modification of the article carrier of the invention showing it unfolded into a generally planar orientation.
FIG. 6 is a front perspective view of the article carrier of FIG. 5 in its configured orientation.

FIG. 1 shows from the front the components of the article carrier of the present invention as they are fixedly connected together in a generally planar orientation. These components are then folded and portions thereof detachably connected together to provide the configured orientation of the article carrier as shown in FIG. 2.

For purposes of describing the invention and its use with reference to the drawings, the surfaces facing the article holding enclosure formed by the configured carrier will be referred to as "inner" surfaces and the surfaces facing away from this enclosure will be referred to as "outer" surfaces. Similarly, "upper", "upward", "lower", "downward", "right" and "left" refer to directions as seen by the observer of FIGS. 1–2 and 4–6 of the drawings.

With reference to FIGS. 1 and 2, article carrier 10 comprises an elongated central strap 12, a cross-strap 14 fixedly connected to an intermediate portion 17 of cross-strap 12, and a relatively short cross-tab 16 fixedly connected to a distal end portion of an upper loop portion 15 of cross-strap 12. Although shown as extending transversely beyond both side edges of central strap 12, cross-tab 16 may be confined within those edges or may extend beyond only one edge.

In the planar orientation shown in FIG. 1, the body of the carrier 10 is shaped substantially like a cross, with the strap 12 being the upright and strap 14 being the transverse beam. In this orientation, the cross-strap 14 and the cross-tab 16 are fixed to the outer surface 18 of central strap 12, preferably by sewn stitches 15 and 21, respectively. A lower end segment 19 of central strap 12 is folded rearwardly upon itself and stitched at 20 to provide a fixed loop 22.

Central strap 12 is preferably made of a relatively thick but flexible woven or non-woven natural or synthetic fiber material of a generic type, such as often used for cloth straps or canvas articles. Cross-strap 14 and cross-tab 16 are preferably made partially or entirely of laminated panels of hook and loop material, more preferably of one of the types currently sold under the trademark "VELCRO" most preferably the VELCRO brand of material referred to in VELCRO literature as "ONE-WRAP", which is described as a back-to-back fastening system featuring a polyethylene hook material panel laminated to nylon loop material panel without the use of an adhesive.

If the cross-strap is made entirely of ONE-WRAP, all of the inside surface 24 of cross-strap 14 will be provided by a hook panel and all of the outer surface 26 thereof will be provided by a loop panel. Similarly, cross-tab 16 may be made entirely of ONE-WRAP so that all of its inner surface 28 is a hook panel and all of its outer surface 30 is a loop panel, the terms "inner" and "outer" referring here to the position of these surfaces when the cross-tab 16 is in its configured orientation as shown in FIG. 2. However, cross-strap 14 and cross-tab 16 may be made primarily of generic fiber materials similar to those from which central strap 12 is made with cooperating hook and loop panels being provided opposite to each other only on the detachably connected opposing surface portions of the carrier structure as described below.

To change the body of article holder 10 from its planar orientation to its configured orientation, the intermediate portion 17 of central strap 12 is folded forwardly upon itself, and a distal end portion 32 of the left segment 14L or a distal end portion 34 of the right segment 14R of cross-strap 14 is passed through the fixed loop 22, whereupon it is overlapped with the distal end portion of the other segment. The overlapped end portions are then pressed together so that hooks on inner surface 24 releasably engage the loops on outer surface 26. Thereafter, the overlapped and detachably connected portions 32 and 34 are adjusted relative to the fixed loop 22 so as to be enclosed therein as shown best in FIG. 3. When so configured, intermediate portion 17 of central strap 12 provides a bottom segment 35 so that the configured article carrier defines an article holding enclosure 57 and will engage five (5) sides of a rectangular article placed therein.

With further reference to FIG. 3, the hooks 36 of segment 14L are shown engaged with the loops 38 of segment 14R in an overlap zone defined by the opposing surfaces of the respective overlapped distal end portions 32 and 34. As evident from FIG. 3, the same manipulations as described above will have the same results irrespective of whether distal end portion 34 is overlapped on the inside or the outside of distal end portion 32, and vice versa. Although each of these distal end portions are shown with a hook panel 24 and a loop panel 26 such that the overlap between these two end portions is reversible in this manner, it is also evident from FIG. 3 that the two end portions may be releasably connected together with only one relatively short panel of hook material on one end portion and one relatively short panel of loop material on the other end portion.

As an optional feature of the invention, it is preferable to use for the central strap 12 a fibrous material having at least some fiber loops 40 capable of being releasably engaged, at least to a sufficient extent to provide substantial retention of the overlap zone within the fixed loop, by the hooks 36 on the side of the distal end portion 34 opposite from the side with loops 38. The advantage of loops 40 is that the overlapped distal end portions of left and right segments 14L and 14R may be releasably secured in position within fixed loop 22 by pressing together the opposing sides 44 and 45 of this loop. This pressing action detachably connects at least one of the distal end portions to fixed loop 22.

At least some fiber loops similar to loops 40 are found on many types of generic synthetic and natural fiber materials, both woven and unwoven. Thus, any such materials having favorable appearance and strength characteristics, and a sufficient population of surface loops to provide the desired degree of releasable retention, may be used for the central strap 12 of this optional embodiment.

In order to provide a belt receiving loop 50 as shown in FIG. 2, the releasable loop portion 15, which comprises that portion of central strap 12 between cross-strap 14 and cross-tab 16, is folded rearwardly on itself so that the hook (or loop) panel on inner surface 28 of cross-tab 16 releasably engages the loop (or hook) panel on the outer surface 26 of cross-strap 14. This engagement may be seen best in FIG. 4, which further illustrates supporting the article carrier 10 on a belt 54 passing through loop 50, and carrying a portable telephone or pager 56 within the article holding enclosure 57 of carrier 10.

Referring now to FIGS. 5 and 6, there is shown a second embodiment of the invention wherein the same numerals are used for like elements of the first embodiment already described with reference to FIGS. 1–4. The second embodiment further comprises a second fixed loop 58 in addition to the fixed loop 22, which is now referred to as the first fixed loop and assumes an upper loop position in the configured article carrier of FIG. 6. Loops 22 and 58 are formed respectively from backwardly folded segments 45 and 67 of an elongated central strap 64, which has a length significantly longer than that of strap 12. The respective ends of second loop segment 67 are fixedly connected to an intermediate portion 66 of central strap 64 by a first set of stitches 68 and a second set of stitches 69. In addition to the cross-strap 14, which is now referred to as the first cross-strap and assumes an upper strap position in the configured carrier, a second cross-strap 60 is fixed to the outer surface of central strap 64 by stitches 61.

In the same manner as first cross-strap 14, the second cross-strap 60 preferably has a panel of hook material extending entirely over its inner surface 62 and a panel of loop material extending entirely over its outer surface 63. The configured carrier orientation of FIG. 6 is formed by folding the central strap 64 of the planar configuration of FIG. 5 in the same manner that the strap 12 of FIG. 1 is folded to provide the configured carrier orientation of FIG. 2. Respective distal end portions of left and right segments 60L and 60R of second cross-strap 60 are overlapped and detachably connected together, and are positioned within and preferably detachably connected to the second fixed loop 58, in the same manner as shown in FIG. 3 for the distal end portions 32 and 34 of the first cross-strap 14.

The embodiment of FIGS. 5 and 6 has two cross-straps and two corresponding fixed loops so as to be capable of carrying relatively large communication devices, such as old-style cellular phones, hand-held two way radios and telephone hand sets, which are considerably larger than the lightweight pagers and flip-phones for which the first embodiment is designed. While there is a large general increase in size between the former and latter devices, the generally larger devices also come in a variety of sizes and shapes that require the corresponding adjustability provided by the second embodiment of the invention.

The second embodiment of the article carrier also illustrates an optional hold-down strap 70, the proximate end portion 72 of which is preferably fixed to the outer surface of transverse segment 14L of first cross-strap 14 by stitching 73, and the distal end portion 71 of which comprises a panel 75 of hook material on its inner surface 76 for releasably engaging the loop panel on the outside surface of transverse segment 14R of cross-strap 14. Although shown with the second embodiment, the elongated hold-down strap 70 is equally usable with the smaller first embodiment of the article carrier shown in FIGS. 1–4. The length of the hold-down strap 70 is preferably chosen so that it will pass entirely over the top of the largest device for which the carrier is to be used and entirely over the transverse width of cross-strap 14, and also will project at least a short distance below the lower edge of cross-strap 14 to provide a downwardly extending gripping tab 74. Gripping tab 74 provides a thumb and finger grip which may be grasp by the user to readily disengage distal end portion 71 of the hold-down strap from cross-strap 14. This disengagement releases the distal end portion 71 of hold-down strap 70 and thereby frees the upper end of the carried device so that it may be removed from the carrier enclosure.

For simplicity of manufacture, the entire inner surfaces of the cross-straps and cross-tabs have been shown as being made of hook material, and the entire outer surfaces of the cross-straps and cross-tabs have been shown as being made of loop material. However, as already mentioned, only the surface areas to be placed in opposition for hook and loop engagement need be made of panels of these respective materials. In addition, any pair of opposing panels shown in the drawings and described herein may be reversed, such as for example by using loop materials on the inner surfaces of the cross-strap(s), the cross-tab and the hold-down strap, and using hook materials on the outer surfaces of the cross-strap(s). However, a disadvantage of the latter arrangement is that hooks on outer surfaces of the article carrier may engage and thereby become entangled with articles of clothing worn by the user.

On the other hand, reversing the arrangement of the hook and loop panels shown in the drawings allows the planar orientations of FIGS. 1 and 5 to be folded into alternative article carriers by folding manipulations opposite to those describe above. For example, folding the intermediate portion 17 rearwardly and the detachable loop portion 15 forwardly and overlapping the respective end portions of the cross-strap 14 within fixed loop 22 will provide another version of the article carrier 10. In this alternative version, the surfaces designated as "inner" and "outer" with reference to FIGS. 1–4 will also be reversed. Therefore, this version may not be as aesthetically attractive as that shown in FIG. 2, and the area of hook and loop engagement between the cross-tab 16 and the cross-strap 14 will be reduced by the intervention of the part of the central strap 12 between broken lines 31, 31 in FIG. 1, such that only the hook panel parts positioned on the alternative "inner" surface of cross-tab 16 beyond the edges of central strap 12 will engage corresponding parts of the loop panel on the alternative "outer" surface of cross-strap 14.

However, the part of the central strap between lines 31, 31 may comprise an additional panel of loop material laminated to the central strap material such that this additional panel is engageable by the central portion of cross-strap 14. Furthermore, a loop panel for releasable engagement by cross-tab 16 may be placed at a location along the outside surface of the central strap other than the location coextensive with the cross-strap, which of course is fixed to the central strap at the latter location. As a further modification, instead of forming projecting "ears" extending transversely beyond the side edges of central strap 12, the cross-tab 16 may be rotated by 90° so that it extends longitudinally for a greater distance along the longitudinal axis of the central strap and is confined within its borders.

A number of other modifications to the article carriers specifically described herein are possible without departing from the scope of the invention as defined by the claims set forth below. For example, as already mentioned, the sizes of the strap areas covered by cooperating panels of hook and loop materials may vary widely, and these sizes may be minimized to provide only the minimum sheer and peal strengths desired between the portions of the respective straps to be releasably engaged. Similarly, the length and width dimensions of the various straps may vary widely depending on the desired range of sizes of articles to be held in the enclosure of the configured article carrier. All of these modifications, as well as other modifications and alternatives that will be readily apparent to persons skilled in the art from the disclosures described herein, are intended to be within the scope of the claims.

What is claimed is:

1. An article carrier supportable by a user belt and adaptable to carry articles of rectangular shape and variable size, said carrier comprising:

an elongated central strap of flexible material having an intermediate portion between first and second end portions, said first end portion being folded and fixed to itself to form a fixed loop;

a cross-strap of flexible material fixed to the intermediate portion of said central strap to form first and second transverse segments extending substantially perpendicularly outward from opposite sides of the intermediate portion of said central strap, each of said first and second transverse segments having a distal end portion adapted to overlap with the distal end portion of the other transverse segment within said fixed loop, and one of said distal end portions comprising a panel of hook material and the other of said distal end portions comprising a panel of loop material such that said overlapped end portions are releasably engageable to configure said carrier from said cross-strap and said central strap, said configured carrier forming an article holding enclosure for receiving and engaging five sides of said rectangular article to hold said article in said carrier, and an article receiving opening for placing said article in said enclosure; and, a cross-tab fixed to the second end portion of said central strap and comprising a releasably engageable panel, said cross-tab being separated from said cross-strap by a releasable loop portion of said central strap foldable upon itself to cause said cross-tab panel to releasably engage a corresponding releasably engageable panel fixedly secured to said central strap and thereby provide a releasable loop adapted to receive said user belt, one of said engageable panels comprising loop material and the other of said engageable panels comprising hook material.

2. An article carrier according to claim 1, wherein said transverse segment panel of hook material and said transverse segment panel of loop material extend from the distal end of the respective transverse segments toward said central strap for a distance at least substantially equal to a width of said fixed loop.

3. An article carrier according to claim 2, wherein said hook panel covers substantially an entire inner surface of its respective transverse segment, and wherein said loop panel covers substantially an entire outer surface of its respective transverse segment.

4. An article holder according to claim 1 wherein said cross-tab extends transversely beyond at least one side edge of said central strap.

5. An article carrier according to claim 4, wherein said cross-tab extends transversely beyond each of opposite side edges of said central strap.

6. An article carrier according to claim 1, wherein said fixed loop is a first fixed loop and said cross-strap is a first cross-strap, and wherein said article carrier further comprises:

a second fixed loop spaced inwardly along the intermediate portion of said central strap from said first fixed loop; and, a second cross-strap fixed to the intermediate portion of said central strap at a position longitudinally along said central strap between said first cross-strap and said second fixed loop, said second cross-strap forming third and fourth transverse segments extending substantially perpendicularly outward from opposite sides of the intermediate portion of said central strap, each of said third and fourth transverse segments of said second cross-strap having a distal end portion adapted to overlap with the distal end portion of the other of said third and fourth transverse segments within said second fixed loop, and one of said second cross-strap distal end portions comprising a panel of hook material and the other of said second cross-strap distal end portions comprising loop material such that said overlapped end portions are releasably engageable to configure said carrier from said cross-straps and said central strap, said second cross-strap cooperating with the intermediate portion of said central strap to form a bottom section of said article carrier.

7. An article carrier according to claim 6, wherein each of said transverse segment hook panels is on an inner surface of its corresponding distal end portion, and wherein each of said transverse segment loop panels is on an outer surface of its corresponding distal end portion.

8. An article carrier according to claim 6 further comprising a hold-down strap having a first end section fixed to the first transverse segment of said first cross-strap, an intermediate section arranged to extend across the opening of said article enclosure, and a second end section arranged to be positioned opposite to an outer surface section of the second transverse segment of said first cross-strap, one of said second end section and said outer surface section comprising a panel of hook material and the other of said second end section and said outer surface section comprising a panel of loop material, such that said second end section is able to be detachably connected to said outer surface section in order for said hold-down strap to releasably retain said article in said article enclosure.

9. An article carrier according to claim 8, wherein the length of said elongated hold-down strap is such that when said second end section is releasably connected to said outer surface section, a distal end portion of said hold-down strap extends laterally across and beyond said outer surface section to provide a gripping tab of sufficient size to be gripped by a thumb and finger of the user for disconnecting said second end section from said outer surface section:

10. An article holder according to claim 8, wherein an inside surface of each of said first and second fixed loops comprises loop material arranged to be releasably engaged by a panel of hook material on the distal end portion of at least one of the transverse segments corresponding to the fixed loop.

11. An article carrier according to claim 6, wherein said transverse segment panels of hook material and said transverse segment panels of loop material extend from the distal end of the respective transverse segments toward said central strap for a distance at least substantially equal to a width of said fixed loop.

12. An article carrier according to claim 11, wherein each of said hook panels covers substantially an entire inner surface of its respective transverse segment, and wherein each of said loop panels covers substantially an entire outer surface of its respective transverse segment.

13. An article carrier according to claim 1 further comprising a hold-down strap having a first end section fixed to the first transverse segment of said cross-strap, an intermediate section arranged to extend across the opening of said article enclosure, and a second end section arranged to be positioned opposite to an outer surface section of the second transverse segment of said cross-strap, one of said second end section and said outer surface section comprising a panel of hook material and the other of said second end section and said outer surface section comprising a panel of loop material, such that said second end section is able to be detachably connected to said outer surface section in order for said hold-down strap to releasably retain said article in said article enclosure.

14. An article carrier according to claim 13, wherein the length of said elongated hold-down strap is such that when said second end section is releasably connected to said outer surface section, a distal end portion of said hold-down strap extends laterally across and beyond said outer surface section to provide a gripping tab of sufficient size to be gripped by a thumb and finger of the user for disconnecting said second end section from said outer surface section.

15. The article carrier of claim 1 wherein an inside surface of said fixed loop comprises loop material arranged to be releasably engaged by a panel of hook material on the distal end portion of at least one of said transverse segments.

16. An article carrier according to claim 1, wherein said transverse segment hook panel is on an inner surface of one of said transverse segments, and wherein said transverse segment loop panel is on an outer surface of the other of said transverse segments.

* * * * *